US011724261B1

(12) United States Patent
West et al.

(10) Patent No.: US 11,724,261 B1
(45) Date of Patent: Aug. 15, 2023

(54) SYNTHESIZER SYSTEM WITH INFLATABLE SEAL AND VALVE ARRANGEMENT

(71) Applicant: INTEGRATED DNA TECHNOLOGIES, INC., Skokie, IL (US)

(72) Inventors: Robert West, Solon, IA (US); Gregory Hodges, Coralville, IA (US); Justin Kline, Cedar Rapids, IA (US); Scott Steburg, North Liberty, IA (US)

(73) Assignee: INTEGRATED DNA TECHNOLOGIES, INC., Coralville, IA (US)

( * ) Notice: Subject to any disclaimer, the term of this patent is extended or adjusted under 35 U.S.C. 154(b) by 119 days.

(21) Appl. No.: 16/872,969

(22) Filed: May 12, 2020

Related U.S. Application Data

(60) Provisional application No. 62/846,867, filed on May 13, 2019.

(51) Int. Cl.
*B01L 3/00* (2006.01)

(52) U.S. Cl.
CPC ..... *B01L 3/50853* (2013.01); *B01L 2300/041* (2013.01); *B01L 2300/047* (2013.01); *B01L 2300/048* (2013.01); *B01L 2300/049* (2013.01); *B01L 2300/06* (2013.01); *B01L 2300/0832* (2013.01)

(58) Field of Classification Search
CPC .. B01J 19/004; B01J 19/0053; B01J 19/0073; B01L 3/5025; B01L 3/50255; B01L 3/565; B01L 2200/026; B01L 2200/027; B01L 2300/081; B01L 2400/0487; B01L 2400/049
See application file for complete search history.

(56) References Cited

U.S. PATENT DOCUMENTS 5,256,312 A * 10/1993 Letersky ..... B01D 29/05 210/767
5,273,718 A 12/1993 Sköld et al.
5,472,672 A 12/1995 Brennan
5,541,314 A * 7/1996 McGraw ..... B01J 19/0046 525/54.11
5,792,430 A * 8/1998 Hamper ..... B01J 19/0046 422/131
6,042,789 A 3/2000 Antonenko et al.
(Continued)

FOREIGN PATENT DOCUMENTS

WO 2000/018503 A2 4/2000

OTHER PUBLICATIONS

Lashkari et al., "An automated multiplex oligonucleotide synthesizer: Development of high-throughput, low-cost DNA synthesis," Proc. Natl. Acad. Sci. USA, Aug. 1995, vol. 92, pp. 7912-7915.

*Primary Examiner* — Jill A Warden
*Assistant Examiner* — Dwayne K Handy
(74) *Attorney, Agent, or Firm* — Michael Best & Friedrich LLP

(57) ABSTRACT

A synthesizer system includes a vacuum block, a sealing plate coupled to the vacuum block, a synthesis plate having a plurality of wells, and an inflatable seal coupled to both the sealing plate and the synthesis plate and forming a seal between the sealing plate and the synthesis plate.

22 Claims, 16 Drawing Sheets

(56) References Cited

U.S. PATENT DOCUMENTS

| | | | | |
|---|---|---|---|---|
| 6,054,100 | A * | 4/2000 | Stanchfield | B01J 19/0046 422/534 |
| 6,491,873 | B2 * | 12/2002 | Roberts | B01D 61/18 141/65 |
| 7,435,390 | B2 | 10/2008 | Cracauer et al. | |
| 7,560,417 | B2 | 7/2009 | Cerrina | |
| 7,754,165 | B2 | 7/2010 | Erden et al. | |
| 8,076,129 | B2 | 12/2011 | Hanafusa et al. | |
| 9,354,145 | B2 | 5/2016 | Angros et al. | |
| 2004/0223885 | A1 | 11/2004 | Keen et al. | |
| 2008/0177054 | A1 | 7/2008 | Evans | |
| 2009/0166976 | A1 * | 7/2009 | Rubner-Petersen | B01J 19/0073 277/315 |
| 2012/0103113 | A1 | 5/2012 | Ting et al. | |
| 2013/0196375 | A1 | 8/2013 | Strobbe | |
| 2014/0274809 | A1 | 9/2014 | Harvey et al. | |
| 2015/0217254 | A1 | 8/2015 | Boroomand | |

* cited by examiner

| VALVE STATUS | | |
|---|---|---|
| 1 | 2 | |
| OPEN | CLOSED | |

SYNTHESIZER SYSTEM WITH INFLATABLE SEAL AND VALVE ARRANGEMENT

CROSS-REFERENCE TO RELATED APPLICATION(S)

This application claims priority to U.S. Provisional Application No. 62/846,867, filed May 13, 2019, the entire contents of which are incorporated herein by reference.

FIELD

The present application relates to a synthesizer system, in particular a synthesizer system for sequencing of oligonucleotides, polymers, and other organic chains.

BACKGROUND

Oligonucleotides, as well as polymers such as peptides, polynucleotides, and other organic chains play significant roles in diagnostic medicine, forensic medicine, and molecular biology research. Accordingly, the use of and demand for synthetic oligonucleotides, polymers, and organic chains has increased. In turn, this has spawned development of new synthesizer systems and methods for basic procedures for custom sequencing of oligonucleotides, polymers, and other organic chains.

Typically, a synthesizer system includes a synthesis plate with wells that hold a plurality of individual membranes or other support material (i.e., material that supports synthesis). Alternatively, the plate holds a plurality of vials containing support material, each vial having its own dedicated well. A typical membrane contains sintered controlled pore glass beads (CPG) or a mixture of a thermoplastic polymer with CPG, and the membranes are placed into the plurality of individual wells and provide stable anchors to initiate the synthesis process in each well. Selected reagents are sequentially placed into the appropriate wells in a predetermined sequence. Contact of the reagents with the support material inside each of the wells causes reactions that result in sequenced growth on the support.

A flushing procedure is typically utilized after each of the particular reagents has been placed into the wells for a predetermined amount of time, and before a new reagent is added to the wells. In a conventional synthesizer system the flushing procedure is performed on all of the wells simultaneously. During the flushing procedure, all of the reagents within the plurality of individual wells are flushed and expelled through the wells and into a shared central orifice within the synthesis machine. After completion of the flushing operation, the support materials are then ready to receive another reagent.

Some conventional synthesizer systems utilize a stationary synthesis plate along with a mobile means (e.g., a head with nozzles) for dispensing the reagents into the wells. However, the amount of reagent to be dispensed into each vial is often very small, and generating movement of the head and nozzles without disrupting the amount of reagents being dispensed, or otherwise disrupting the reagents, can be difficult. Other systems instead utilize a stationary dispensing means and include a mobile synthesis plate that moves underneath the stationary dispensing means to receive the reagents into each of the wells. However, the diameter of the nozzles and wells is often very small, and thus a synthesis plate with even minimal amounts of movement or shifting during synthesis may result in misplaced reagents.

SUMMARY

In accordance with one embodiment, a synthesizer system includes a vacuum block, a sealing plate coupled to the vacuum block, a synthesis plate having a plurality of wells, and an inflatable seal coupled to both the sealing plate and the synthesis plate and forming a seal between the sealing plate and the synthesis plate.

In accordance with another embodiment, synthesizer system includes a vacuum block, a sealing plate coupled to the vacuum block, a synthesis plate having a plurality of wells, a vacuum chamber defined between a bottom of the synthesis plate and the vacuum block, and a plurality of valves coupled to the vacuum chamber. The plurality of valves includes a first valve, a second valve, a third valve, a fourth valve, a fifth valve, a sixth valve, and a seventh valve. The first valve is an air valve coupled to both the vacuum chamber and an environment external to the synthesis plate and vacuum block. The second and third valves are fluid valves coupled to both the vacuum chamber and to a waste separator. The fourth valve is an air valve coupled to the vacuum chamber. The fifth valve is an air valve coupled to both the waste separator and to a vacuum source. The sixth valve is an air valve coupled to both the fourth valve and to an air vent. The seventh valve is an air valve coupled to both the fourth valve and to an air compressor.

Other embodiments and aspects of various embodiments will become apparent by consideration of the detailed description and accompanying drawings.

Before any embodiments are explained in detail, it is to be understood that embodiments are not limited in their application to the details of construction and the arrangement of components set forth in the following description or illustrated in the following drawings. Other embodiments are possible and embodiments described and illustrated are capable of being practiced or of being carried out in various ways.

DETAILED DESCRIPTION

FIGS. 1-16 illustrate a synthesizer system 10. The system 10 may be used for example to synthesize oligonucleotides, as well as polymers such as peptides, polynucleotides, and other organic chains.

Figure 1:
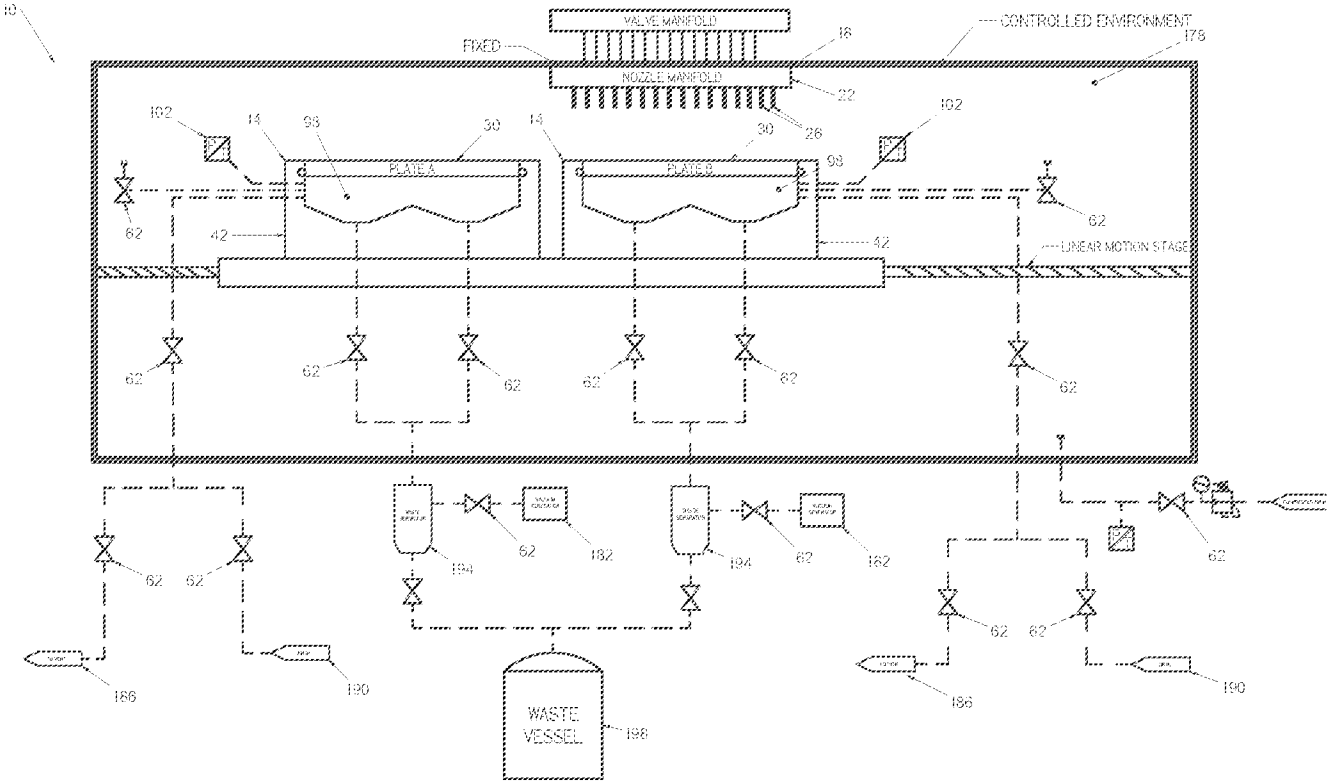
FIG. 1 is a schematic view of a synthesizer system according to one embodiment.
Figure 2:
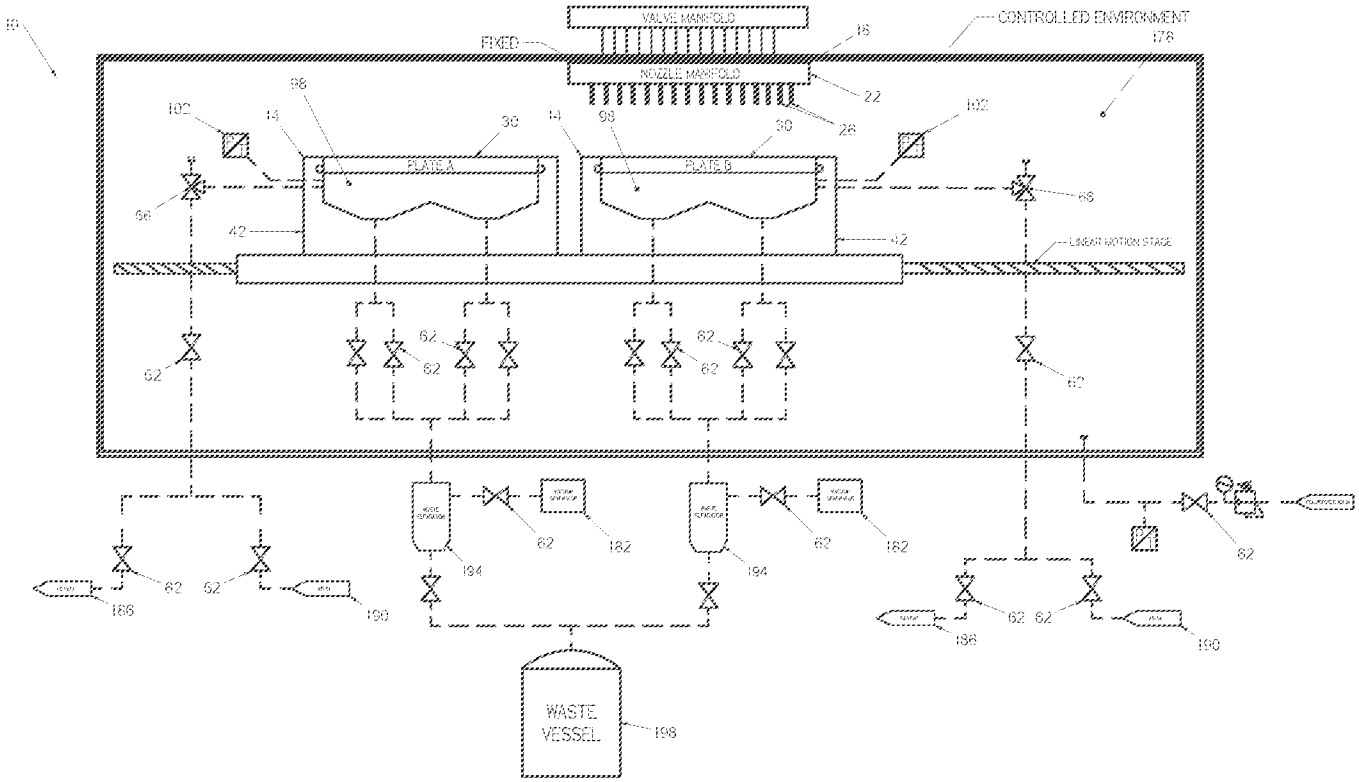
FIG. 2 is a schematic view of a synthesizer system according to another embodiment.
Figure 3:
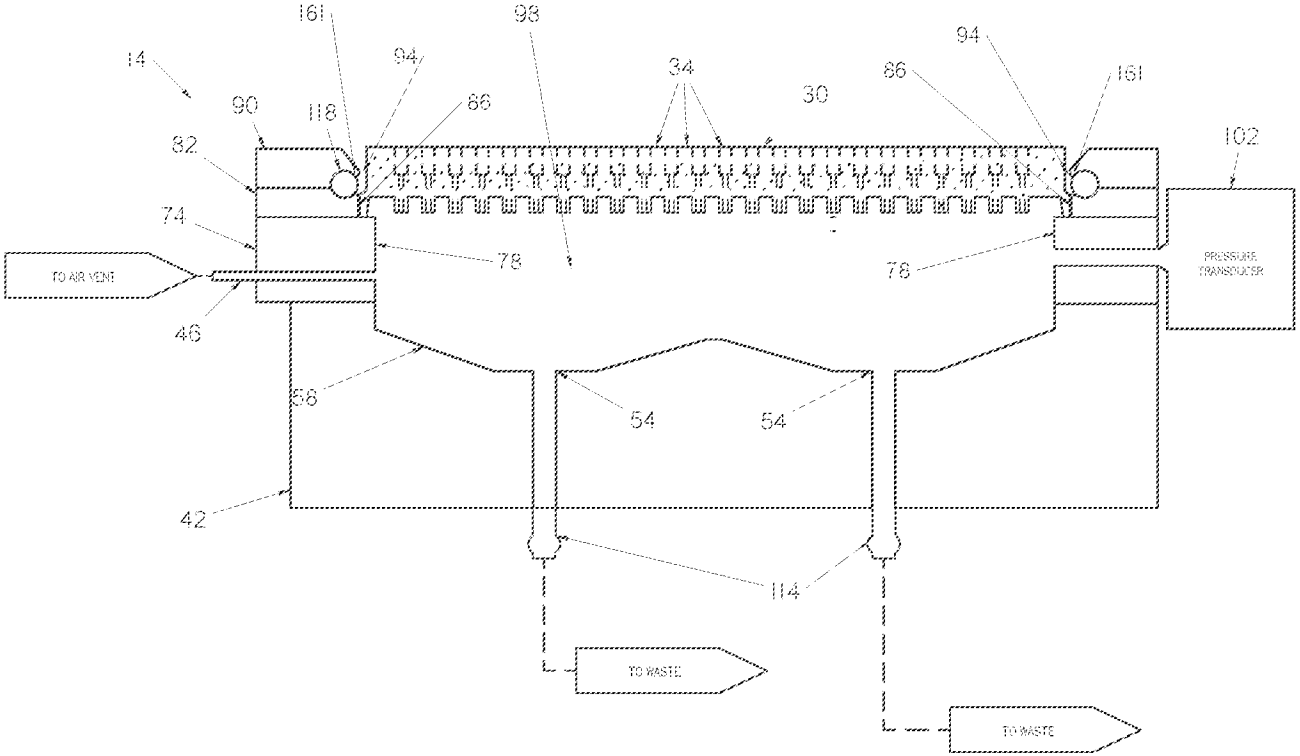
FIG. 3 is a partial cross-sectional view of a portion of the system of FIG. 1.

With reference to FIGS. 1-3, the system 10 includes at least one synthesis plate assembly 14 and a dispensing assembly 18 that delivers reagents to the synthesis plate assembly or assemblies 14. In the illustrated embodiments the dispensing assembly 18 is stationary, while the synthesis plate assembly or assemblies 14 are movable underneath the dispensing assembly 18. In other embodiments the dispensing assembly 18 is movable, while the synthesis plate assembly or assemblies 14 are stationary. The dispensing assembly 18 includes at least one dispensing unit 22 having a plurality of nozzles 26 (FIGS. 1 and 2). The synthesis plate assembly 14 includes a synthesis plate 30 (FIG. 3) having a plurality of individual wells 34 (e.g., arranged in rows or a matrix). The wells 34 are each shaped and sized to receive a support material (e.g., round material that fits into the well 34), or alternatively a vial that itself includes a support material. During operation, reagents are dispensed from the nozzles 26 onto the support materials and/or into the vials.

In some embodiments, at least one row of vials (or support materials) may be positioned within at least one row of the individual wells 34. While not illustrated, each of the vials (or support materials) may include a controlled pore glass bead (CPG) to provide stable anchors to initiate a synthesis process in each of the wells 34. Contact of the reagents with the CPGs causes reactions that result in sequenced growth on the CPGs. Sequential deposits of selected reagents within the wells 34 build the desired oligonucleotides, peptides, polynucleotides, or other organic chains.

With continued reference to FIGS. 1-3, the synthesis plate assembly 14 includes a vacuum block 42. In the illustrated embodiments a plurality of connection channels also pass through the vacuum block 42. With reference to FIG. 3, in some embodiments two of the connection channels open up along apertures 54 on an upper surface 58 of the vacuum block 42. Connection channels may also open up along apertures 54 along sides of the vacuum block 42.

With reference to FIGS. 1-3, at least one two-way valve 62 and/or three-way valve 66 (FIG. 2) is coupled to the vacuum block 42 and to the connection channels. During operation, the two-way and three-way valves 62, 66 are used to control pressures within the synthesis plate assembly 14 and to control flushing of reagents from the wells 34 and/or vials. For example, and as described further herein, the valves 62, 66 may be used to move air through a channel or channels 46 to regulate air pressure below the synthesis plate 30 in a vacuum chamber area 98, and to draw reagents down through the apertures 54 along the upper surface 58 and move the reagents to a waste disposal. These valves are used to regulate the pressure differential above and below the synthesis plate 30, in order to control the rate at which the flushing reagents flow through the CPG columns in synthesis plate 30. Other embodiments include different numbers and arrangements of valves than that illustrated, as well as different types of valves than that illustrated.

With reference to FIG. 3, in some embodiments the synthesis plate assembly 14 further includes an under plate 74 coupled (e.g., fastened with screws or other fasteners) to the vacuum block 42. The under plate 74 includes an under plate central opening 78. The synthesis plate assembly 14 also includes a first sealing plate 82 coupled (e.g., fastened with screws or other fasteners) to the under plate 74. The first sealing plate 82 includes a first sealing plate central opening 86 that is aligned with the under plate central opening 78. The synthesis plate assembly 14 also includes a second sealing plate 90 coupled (e.g., fastened with screws or other fasteners) to the first sealing plate 82. The second sealing plate 90 includes a second sealing plate central opening 94 that is aligned with both the first sealing plate central opening 86 and the under plate central opening 78. Other embodiments include different number of plates, as well as different sizes and shapes of plates than that illustrated.

Figure 5:
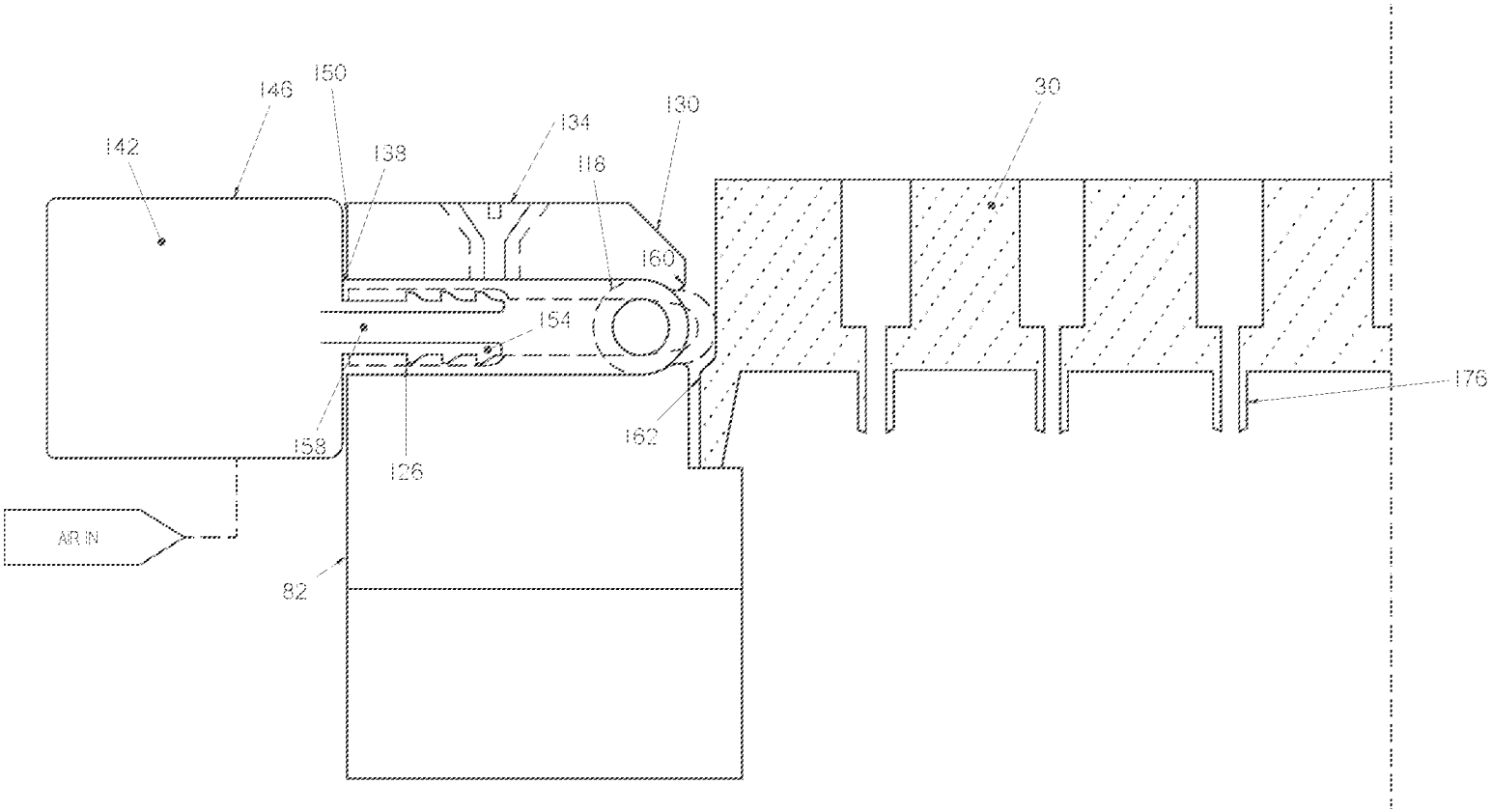
FIG. 5 is a partial cross-sectional view of a portion of the system of FIG. 3.

With reference to FIGS. 3 and 5, the synthesis plate 30 may be sized and shaped to sit within the second sealing plate central opening 94 and the first sealing plate central opening 86, such that the vacuum chamber 98 is formed underneath the synthesis plate 30 and above the upper surface 58 of the vacuum block 42. With reference to FIG. 2, the synthesis plate assembly 14 may further include a pressure transducer 102 in communication with the vacuum chamber 98 and vacuum block 42 to monitor pressures within the synthesis plate assembly 14. The pressure transducer 102 is used, for example, to monitor the environment under the synthesis plate 30 (e.g., as a diagnostic tool and/or as a real time indicator of synthesis quality). The transducer 102 provides information regarding the health of the system 10. In some embodiments, the transducer 102 is used only during initial startup to verify a synthesis plate 30 is present and has membranes loaded with a pre-synthesis vacuum check. The pressure transducer 102 may measure a pressure in the vacuum chamber 98. Other embodiments do not include the pressure transducer 102.

With reference to FIG. 3, the synthesis plate assembly 14 may further include fittings 114 coupled to a bottom of the vacuum block 42. The fittings 114 are coupled to one or more further valves, and/or to a waste vessel, and are used to move reagents from the vacuum block 42 to the waste vessel. Other embodiments include different numbers or types of fittings than that illustrated.

Figure 4:
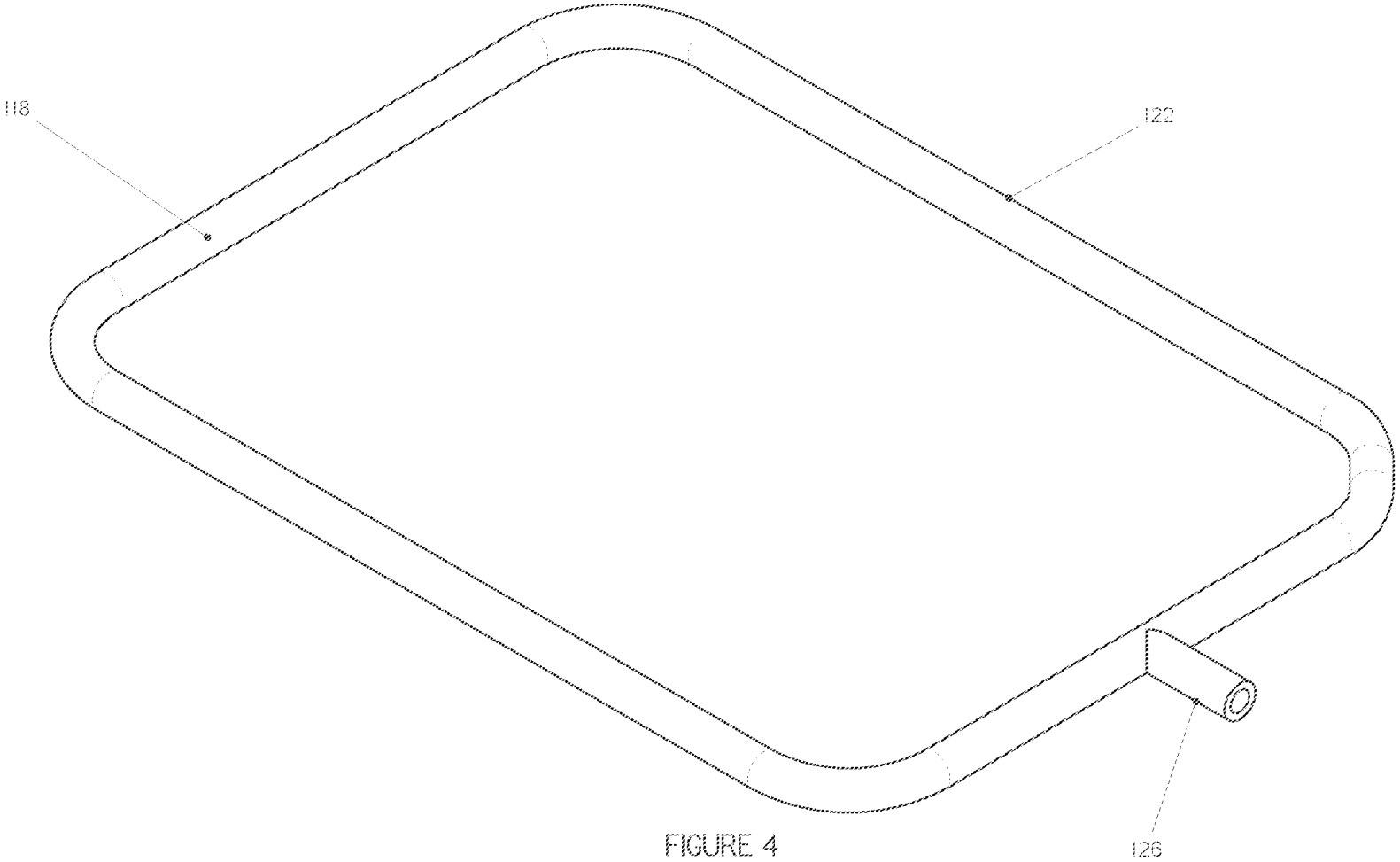
FIG. 4 is a perspective view of a synthesis plate seal of the system of FIG. 1.

With reference to FIGS. 3-5, the synthesis plate assembly 14 may further include an inflatable seal 118 having a main body 122 and a stem 126 extending therefrom. The main body 122 forms a loop (e.g., a generally rectangular loop), with the stem 126 extending away from the main body 122 along one side of the main body 122. In some embodiments, the stem 126 is removably coupled to the main body 122. In other embodiments the stem 126 is integrally formed as a single piece with the main body 122. In the illustrated embodiment the main body 122 and the stem 126 are hollow tubular structures. As illustrated in FIGS. 3-5, the main body 122 is sized and shaped to fit between the synthesis plate 30 and the second sealing plate 90, and for example to form a seal therebetween when inflated. The main body 122 and stem 126 may each be made of elastomeric material or any other material suitable for creating a seal.

With reference to FIG. 5, the synthesis plate assembly 14 may further include a seal retainer 130 that is removably coupled to the second sealing plate 90 (e.g., with one or more fasteners 134). The seal retainer 130 fits over the stem 126 and retains the stem 126 in place during use. As illustrated in FIG. 5, the stem 126 includes a proximal end 138 defining an opening. A fitting 142 is removably coupled to the proximal end 138 to provide inflation to the seal retainer 130. The fitting 142 includes a body 146 that is pressed against an outer surface 150 of the seal retainer 130, as well as a projecting region 154 that extends into the stem 126. A passage 158 extends through the body 146 and the projecting region 154. To inflate the inflatable seal 118, air or other gas or fluid is moved through the passage 158, into the stem 126, and through the entire main body 122.

With continued reference to FIG. 5, the seal retainer 130 includes a lip 160 that projects down and over a periphery of the main body 122. The lip 160 facilitates retention of the main body 122 once the main body 122 has been inflated. The second sealing plate 90 also includes a similar lip 161 (as seen in FIG. 3) extending entirely around an interior of the second sealing plate 90. Thus, the main body 122 of the inflatable seal 118, once expanded to a size such as that illustrated in FIG. 4, is retained and held by both the lip 160 and the corresponding lip 161 on the second sealing plate 90. Additionally, in the illustrated embodiment the synthesis plate 30 includes a rib 162 (e.g., step or ledge) extending from an outer surface of the synthesis plate 30. The rib 162 also facilitates retention of the main body 122 of the inflatable seal 118. For example, as illustrated in FIGS. 3 and 5, once the main body 122 has been fully inflated, the main body 122 contacts both the lips 160, 161 and the rib 162, and is thus held tightly in place, facilitating the seal between the synthesis plate 30 and the second sealing plate 90 and/or seal retainer 130. In some embodiments the inflatable seal 118 is made of a compliant material that accommodates inconsistencies in the shape and size of the rib 162 and/or the lips 160, 161.

Other embodiments include various other configurations of the inflatable seal 118, as well as the elements that retain the inflatable seal 118. For example, in some embodiments the rib 162 is not provided, and the main body 122 seals tightly against the outer surface of the synthesis plate 30 without the use of the rib 162. In yet other embodiments the rib 162 has a different shape or profile than that illustrated. Additionally, the lip 160 or 161 may have other shapes or profiles than that illustrated, or may be omitted entirely. In yet other embodiments the inflatable seal 118 may be held in place by one or more clamps, wedges, or other structures that facilitate a tight seal between the synthesis plate 30 and the second sealing plate 90 and/or seal retainer 130.

Use of the inflatable seal 118 may serve multiple purposes. First, and as described above, the inflatable seal 118 provides a tight seal between the synthesis plate 30 and the second sealing plate 90 and/or seal retainer 130. This seal 118 helps to maintain desired pressure differentials within the system 10. Additionally, because of the shape and positioning of the main body 122 of the inflatable seal 118 entirely or substantially entirely around the synthesis plate 30, the inflatable seal 118 also helps to center and stabilize the synthesis plate 30. As described above, in some embodiments the synthesis plate 30 may be moved underneath the nozzles 26 so that reagents may be distributed from the nozzles 26 and into the wells 34 or vials that are sitting within the wells 34 of the synthesis plate 30. If the synthesis plate 30 is not tightly coupled to the second sealing plate 90 and is not stabilized, the synthesis plate 30 may move or shift slightly as it is being moved underneath the various nozzles 26. Even a slight shifting in the synthesis plate 30 may significantly affect the amount of reagent material that is deposited into the wells 34 or vials. Thus, by centering and stabilizing the synthesis plate 30 with the inflatable seal 118, the likelihood of shifting may be significantly reduced or eliminated entirely.

Additionally, while the inflatable seal 118 is described in the context of being used with a synthesizer system 10, the inflatable seal 118 may be used in other machines, systems, or environments as well (e.g., any system where it is desirable to immobilize a plate, slide, panel, or any other part whose function may be improved by immobilization and/or by heightened control of pressure differentials between top and bottom sides of the system).

Figure 16C:
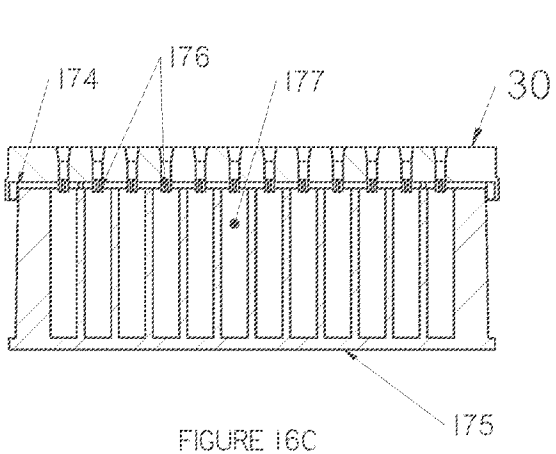
FIG. 16C is a cross-sectional view of the synthesis plate of FIG. 16A.
Figure 16B:
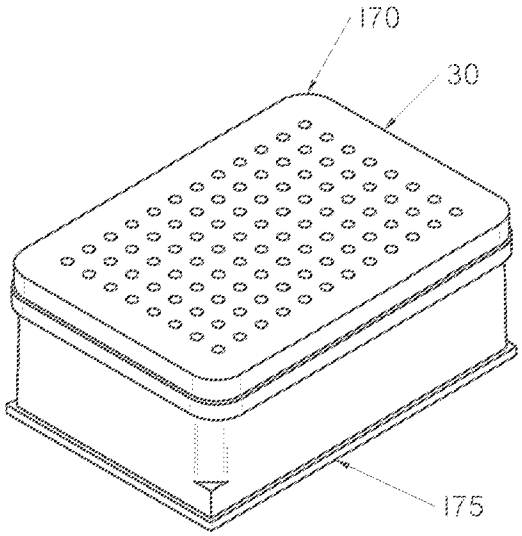
FIG. 16B is a top perspective view of the synthesis plate of FIG. 16A.
Figure 16A:
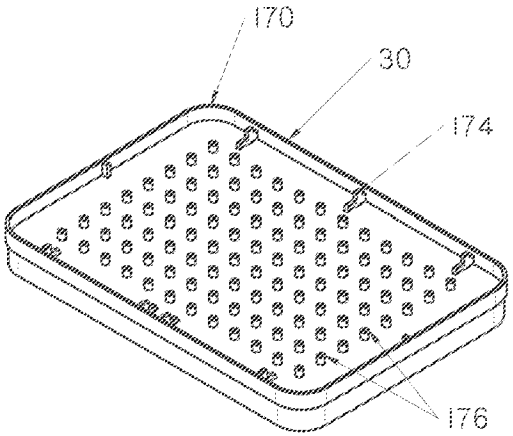
FIG. 16A is a bottom perspective view of a synthesis plate of the system of FIG. 1.

With reference to FIGS. 16A-C, in some embodiments the synthesis plate 30 includes rounded corners 170 to accommodate the shape of the inflatable seal 118 and to facilitate a better seal than may be achieved with sharper corners. The synthesis plate 30 may include one or more stand-offs 174 (e.g., protrusions, etc. of various sizes and shapes as illustrated in FIG. 16A) to prevent a catch plate 175 (FIGS. 16B, 16C) from coming into contact with the synthesis plate 30. The catch plate 175 may be used for example to collect synthesized organic chains. However, contact between the catch plate 175 and the synthesis plate 30 is generally not desired (e.g., because of potential cross-contamination). Thus, the stand-offs 174 help to keep a constant distance between the synthesis plate 30 and the catch plate 175. Various types of synthesis plates with stand-offs may be used. For example, the synthesis plate 30 may be a machined Teflon plate, or an injection molded plate, with the stand-offs 175 included. FIGS. 16A and 16C illustrate the synthesis plate 30 and the catch plate 175, where the stand-offs 174 are tabs that locate and hold the catch plate 175 centered underneath the synthesis plate 30 and also prevent the top of the catch plate 175 from contacting the bottom of the synthesis plate 30. As illustrated in FIG. 16C, the synthesis plate 30 may include nozzles 176 that sit inside wells 177 of the catch plate 175. The stand-offs 174 prevent contact of the synthesis plate nozzles 176 to the catch plate wells 177 so as to prevent cross-contamination.

Figure 6:
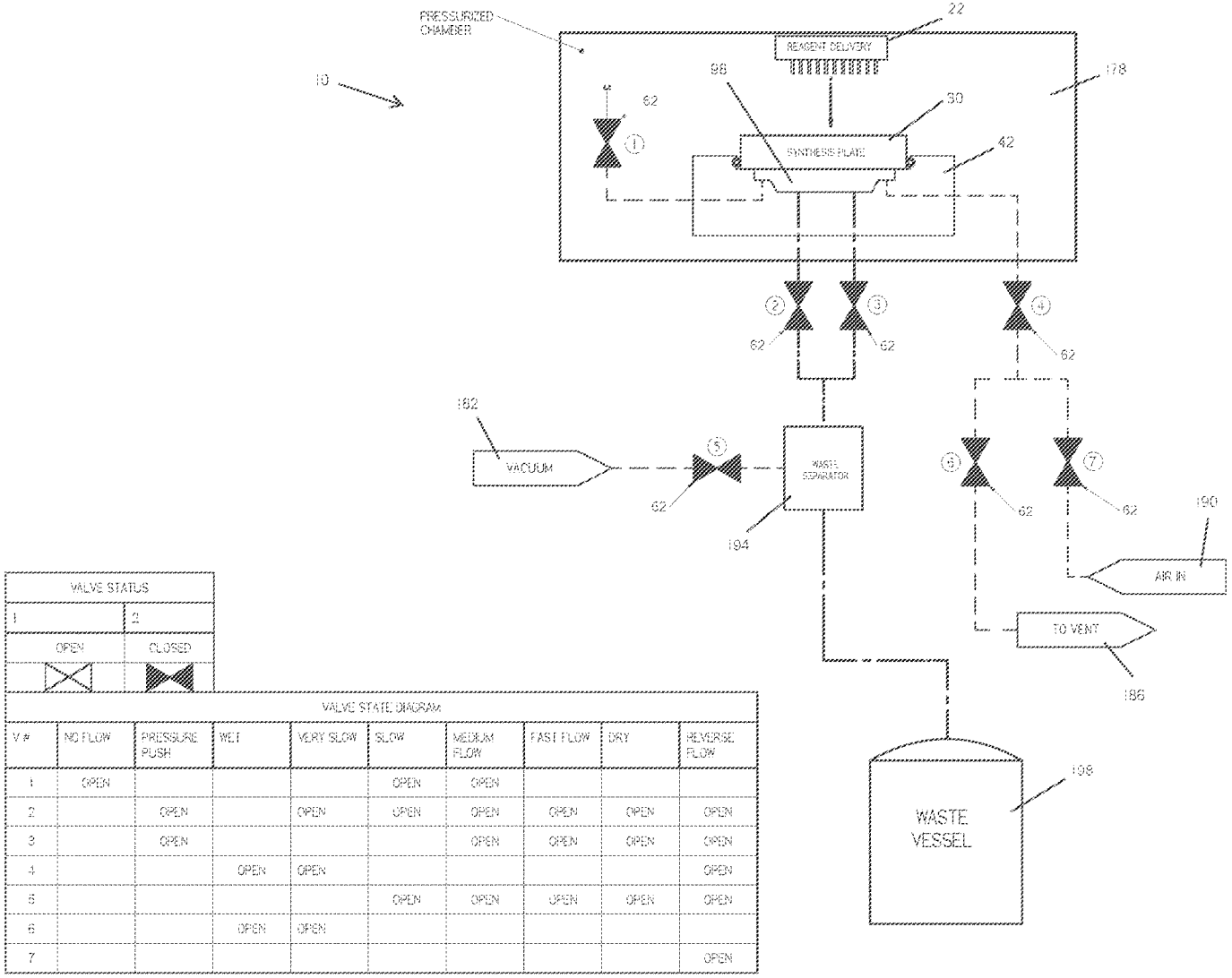
FIG. 6 is a chart illustrating valve operations of the system of FIG. 1, as well as a schematic representation of a portion of the system of FIG. 1.

With reference to FIGS. 1, 2, and 6, and as described above, various valves (e.g., valves 62, 66) may be used within the system 10 to control the pressure within the vacuum chamber 98 beneath the synthesis plate 30 and to control the overall pressure differentials within the system 10 and movement of reagents. As explained above, during operation the two-way valves 62 (and/or three-way valves 66) are used to control pressures within the synthesis plate assembly 14 and to control flushing of reagents from the wells 34 and/or vials. For example, the valves 62, 66 may be used to move air through the channel or channels 46 to regulate air pressure below the synthesis plate 30 in the vacuum chamber area 98, and to draw reagents down through the apertures 54 along the upper surface 58 and move the reagents to a waste disposal. These valves are used to regulate the pressure differential above and below the synthesis plate 30, in order to control the rate at which the flushing reagents flow through the CPG columns in synthesis plate 30.

FIG. 6 schematically illustrates one such arrangement of the valves in the system 10. In the illustrated embodiment, the valves 1-7 as labeled in FIG. 6 each represent one of the two-way valves 62 described above. As illustrated in FIG. 6, the synthesis plate 30, the vacuum block 42, and the reagent dispensing unit 22 are all generally contained within a controlled (e.g., pressurized) chamber or environment 178. Seven different valves are illustrated in FIG. 6, labeled as 1-7. Each of the valves 1-7 includes an open position and a closed position. Valves 1-4 are each coupled for example to the vacuum chamber 98 described above. Valves 1 and 4-7 are valves that control a flow of air (represented by the shorter dashed lines), whereas valves 2 and 3 control a flow of reagents (represented by the longer dashed lines). Valves 1 and 2 may be in communication, for example, with one or more of the channels 46, and valves 2 and 3 may be in communication with one or more of the channels passing through the vacuum block 42 and/or with the apertures 54 along the upper surface 58 of the vacuum block 42, and/or with one or more of the fittings 114. Additionally, as illustrated in FIG. 2, in some embodiments the pressure transducer 102 described above may be provided to monitor the pressure within the vacuum chamber 98 and/or the vacuum block 42.

With continued reference to FIG. 6, valve 5 is coupled to a vacuum source (e.g., a vacuum pump) 182. Valve 6 is coupled to an air vent 186. Valve 7 is coupled to a source of compressed air (e.g., conventional air compressor) 190. As illustrated in FIG. 6, valves 2 and 3 are arranged above a waste separator 194, and are configured to control movement of reagents to the waste separator 194. Valve 5 is configured to control a pressure differential applied through the waste separator 194. A waste vessel 198 is disposed below the waste separator 194, and is used to collect the reagents. In some embodiments the waste separator 194 is a sintered stainless steel filter held in place by a Teflon disc. A mixed flow enters at an area below the filter and the vacuum is pulled from above the filter. During short bursts the mixed flow enters the separator 194 and the fluids run down to a funnel at a bottom and are discharged (e.g., via a valve).

FIGS. 7-15 schematically illustrate various operating conditions for the system 10, based on the chart of FIG. 6. The valves 1-7 in FIGS. 7-15 are represented in a closed state when shown as solid black, and are represented in an open state when shown only in outline.

Figure 7:
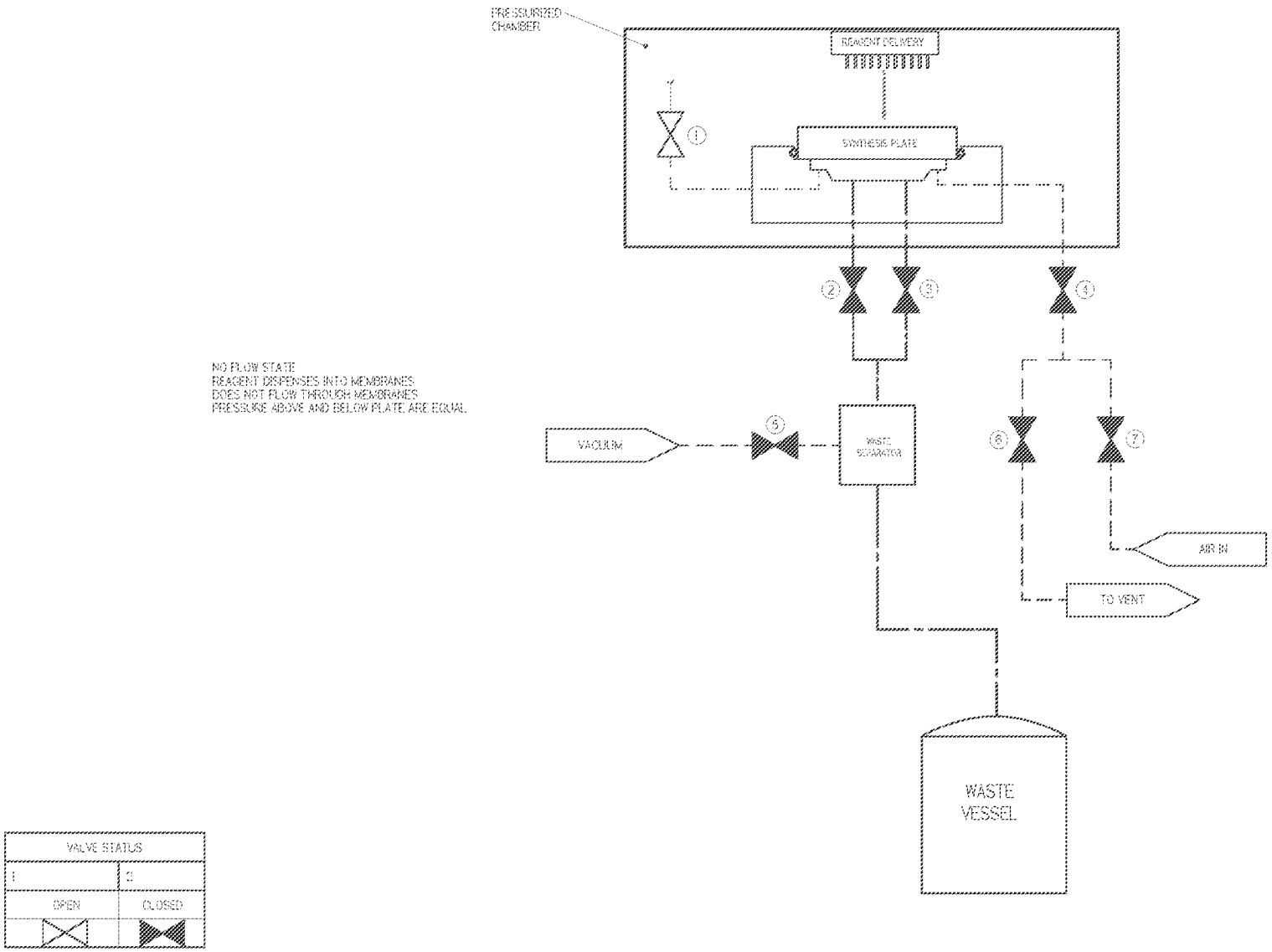
FIGS. 7-15 are schematic views of the system of FIG. 1, illustrating the various valve operations shown in the chart of FIG. 6.

Thus, with reference to FIGS. 6 and 7, in a "no flow" operating condition, valve 1 is open, and valves 2-7 are closed. In this condition a pressure within the vacuum chamber 98 is generally equal with the pressure in the environment 178 outside.

Figure 8:
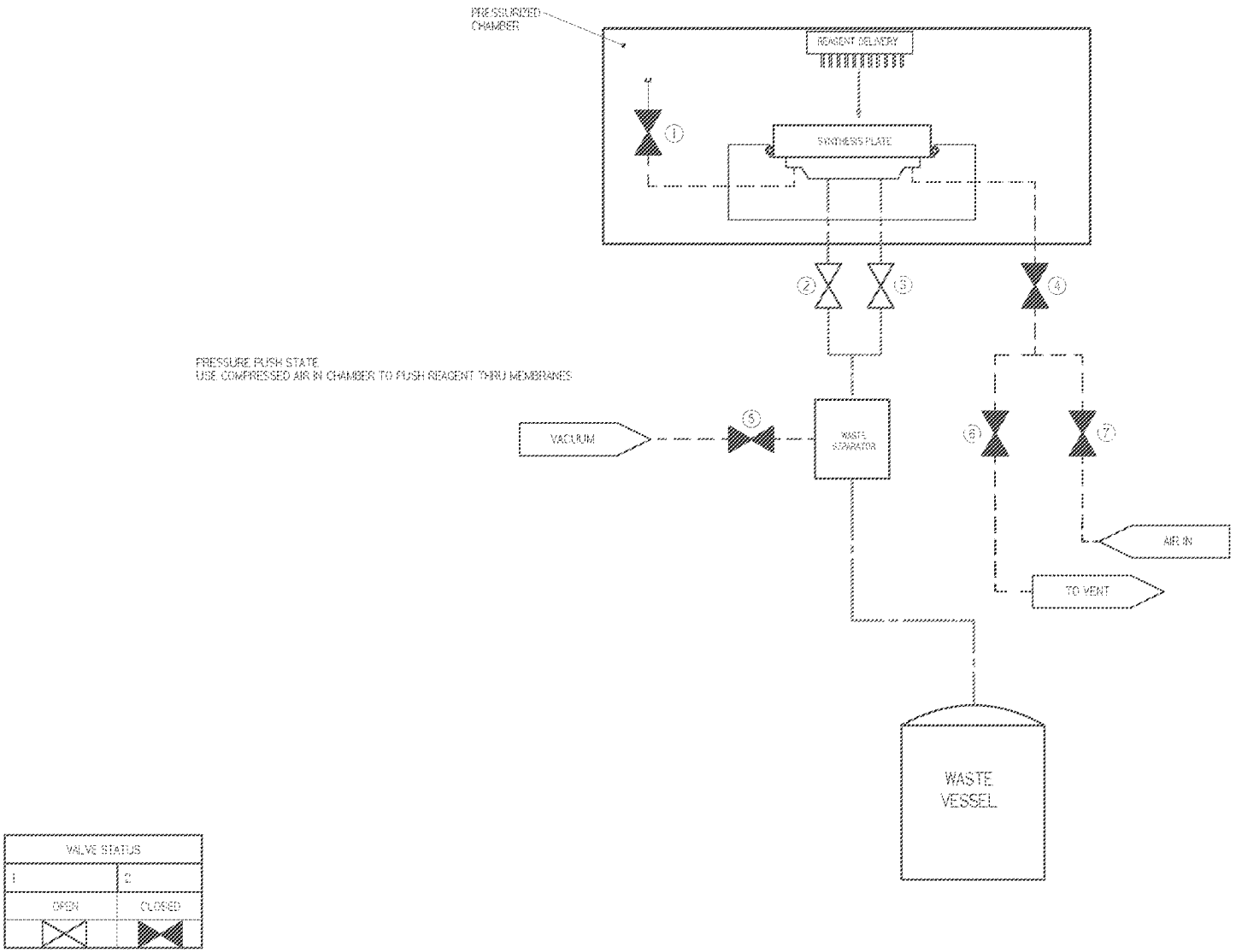

With reference to FIGS. 6 and 8, in a "pressure push" condition, valves 2 and 3 are open, and valves 1 and 4-7 are closed. In this condition reagent is pushed down through the valves 2 and 3 and into the waste separator 194 and waste vessel 198 (e.g., due to a gravity pull of the reagents down through the vacuum block 42 and/or a higher pressure in the environment 178 than within the vacuum chamber 98).

Figure 9:
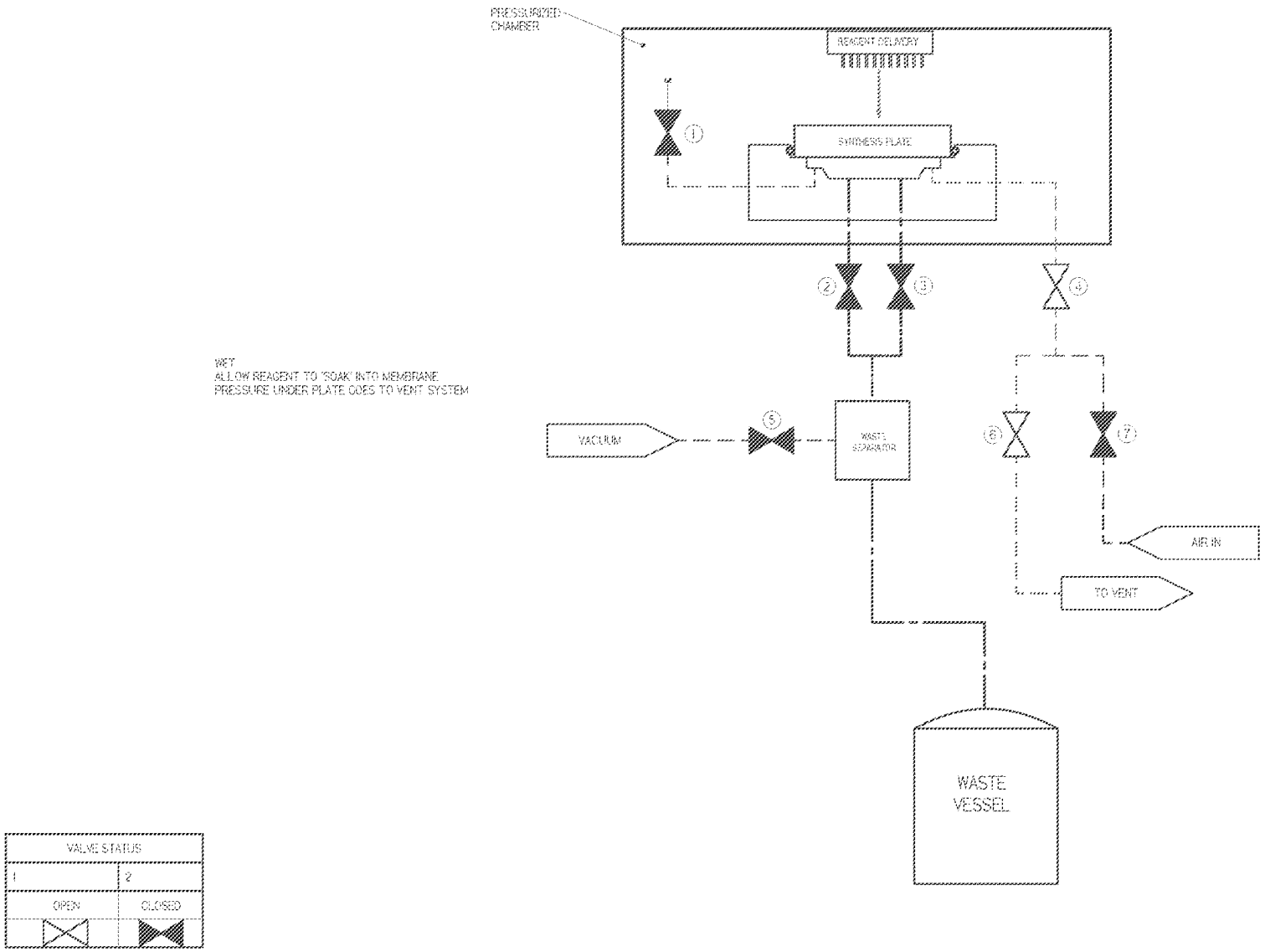

With reference to FIGS. 6 and 9, in a "wet" condition valves 1-3, 5, and 7 are closed, and valves 4 and 6 are open. In this condition, reagent soaks into the membranes forming around the CPGs in the wells 34 or vials.

Figure 10:
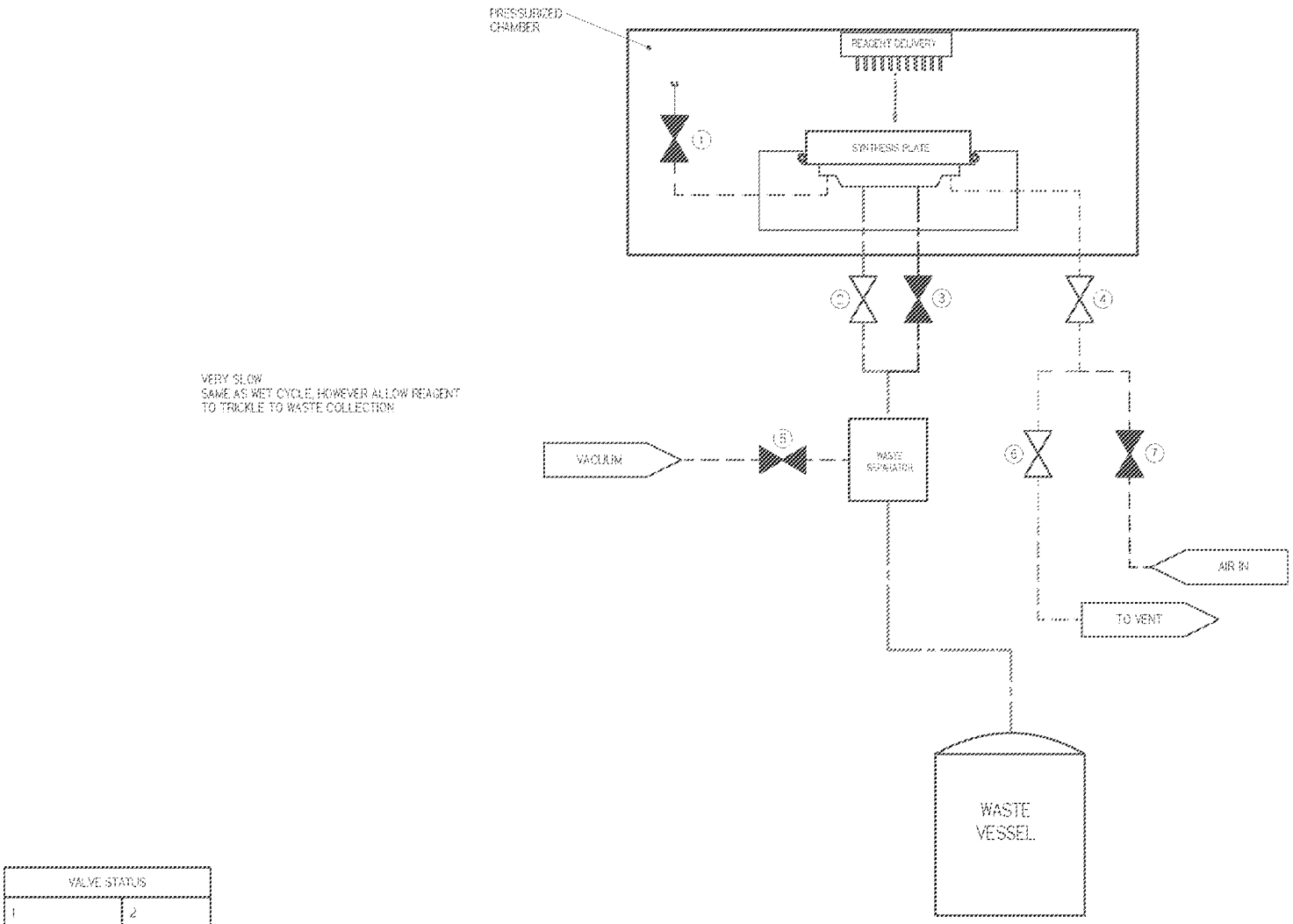

With reference to FIGS. 6 and 10, in a "very slow" condition valves 1, 3, 5, and 7 are closed, and valves 2, 4, and 6 are open. In this condition, reagent moves very slowly from the vacuum block 42 down through valve 2 (e.g., trickles down) and into the waste separator 194 and the waste vessel 198.

Figure 11:
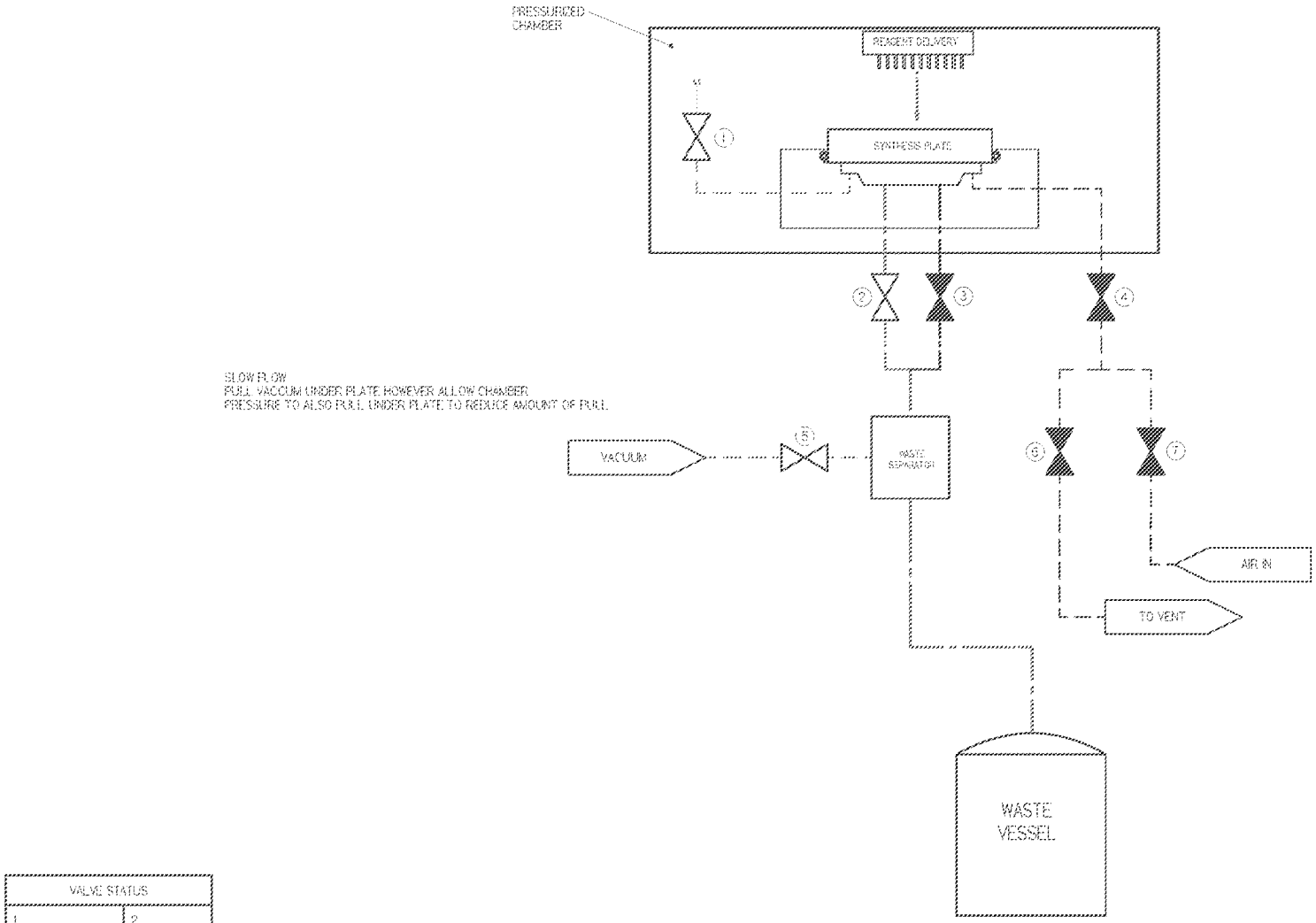

With reference to FIGS. 6 and 11, in a "slow" condition, valves 3, 4, 6, and 7 are closed, and valves 1, 2, and 5 are open. In this condition, reagent moves slowly (but not as slowly as in the very slow condition) from the vacuum block 42 through the valve 2, and into the waste separator 194 and the waste vessel 198. In this condition, the vacuum source 182 is used to draw the reagent down and into the waste separator 194, creating a vacuum under the synthesis plate 30 in the vacuum chamber 98 to help expedite the flow.

Figure 12:
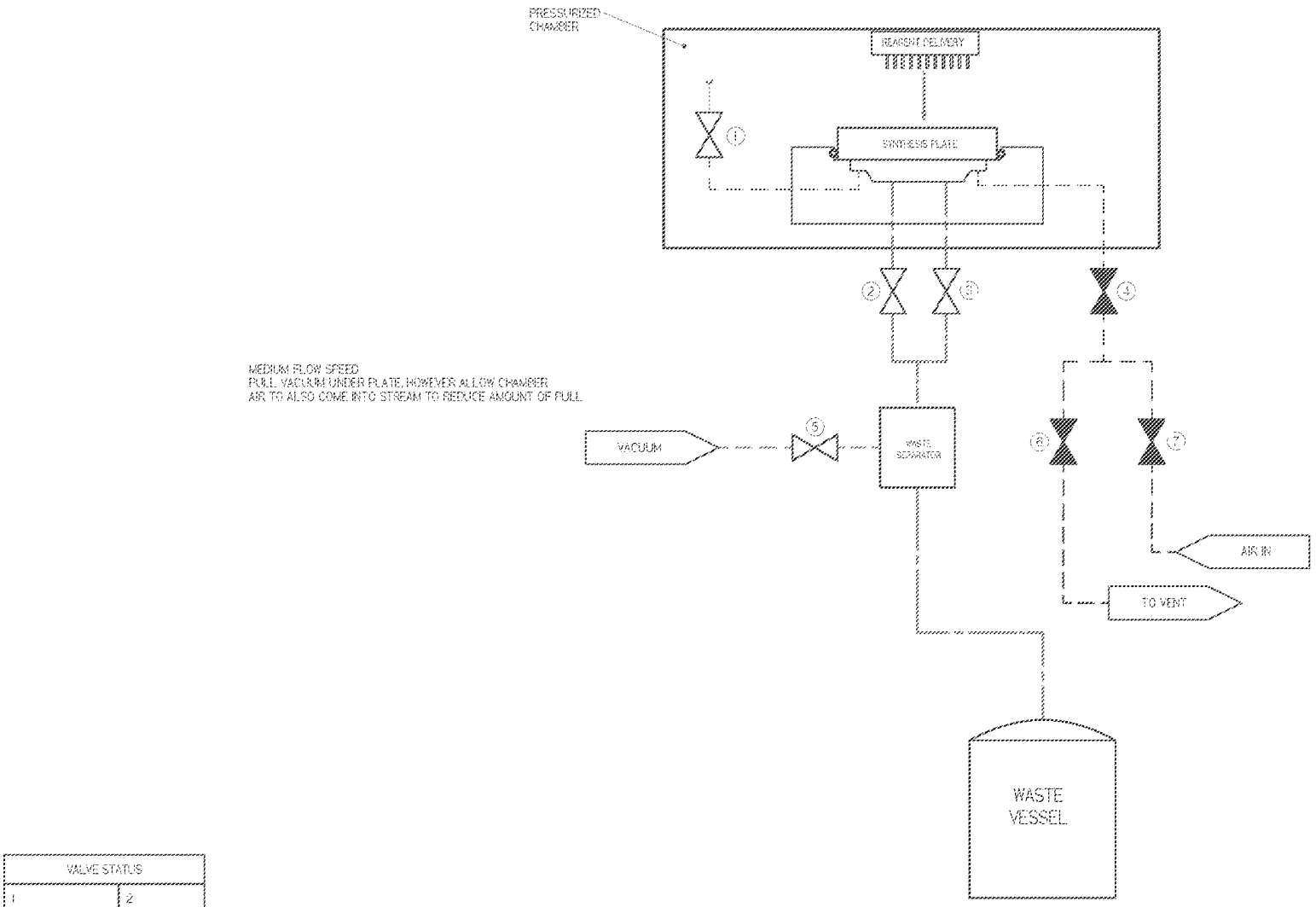

With reference to FIGS. 6 and 12, in a "medium flow" condition, valves 4, 6, and 6 are closed, and valves 1-3 and 5 are open. In this condition, the vacuum source 182 is still being used to draw reagent down and into the waste separator 194 and create a vacuum under the synthesis plate 30 in the vacuum chamber 98. The opening of the valve 3 provides for an increased flow rate, however, as compared to the slow condition of FIG. 14.

Figure 13:
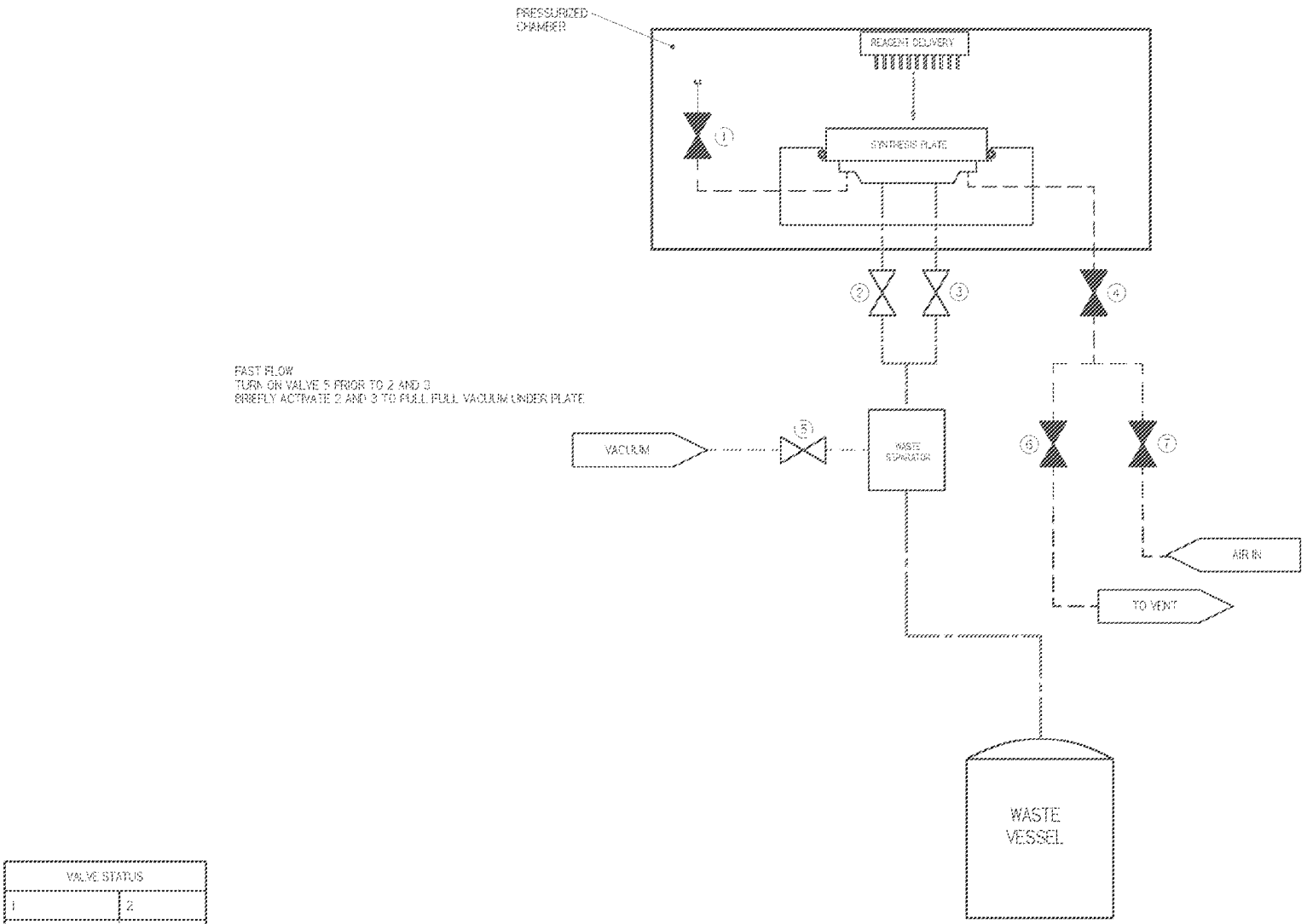

With reference to FIGS. 6 and 13, in a "fast flow" condition, valves 1, 4, 6, and 7 are closed, and valves 2, 3, and 5 are open. The valve 5 may be turned on, for example, prior to turning on valves 2 and 3. In this condition, valve 1 has been closed off as compared to the medium flow condition in FIG. 12. In this condition a further increased flow is generated as compared to the medium flow condition.

Figure 14:
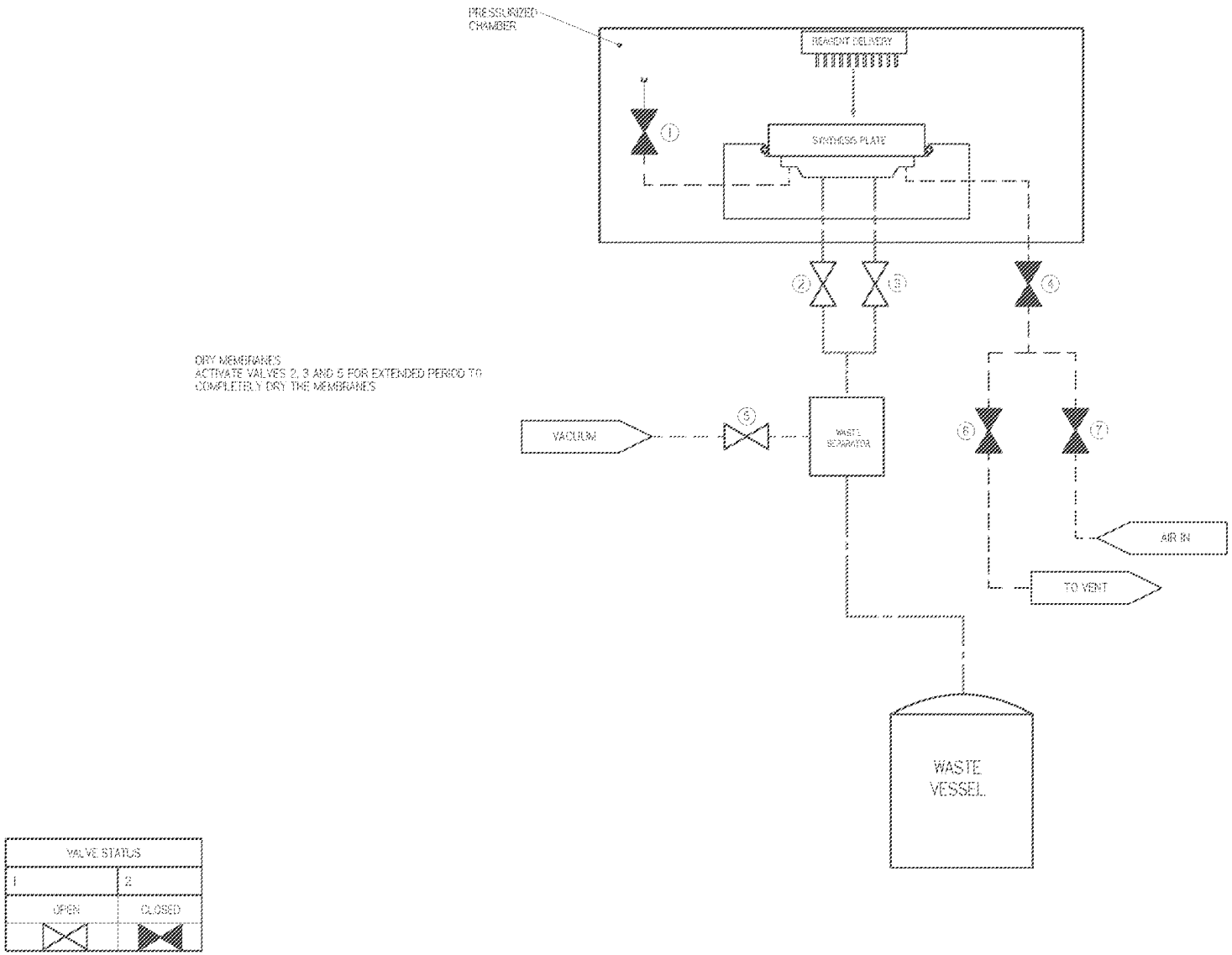

With reference to FIGS. 6 and 14, in a "dry" condition, the valves 1, 4, 6, and 7 are again closed, and the valves 2, 3, and 5 are again open, in this instance for an extended period of time to completely dry out membranes that have formed in the wells 34 or vials around the CPGs.

Figure 15:
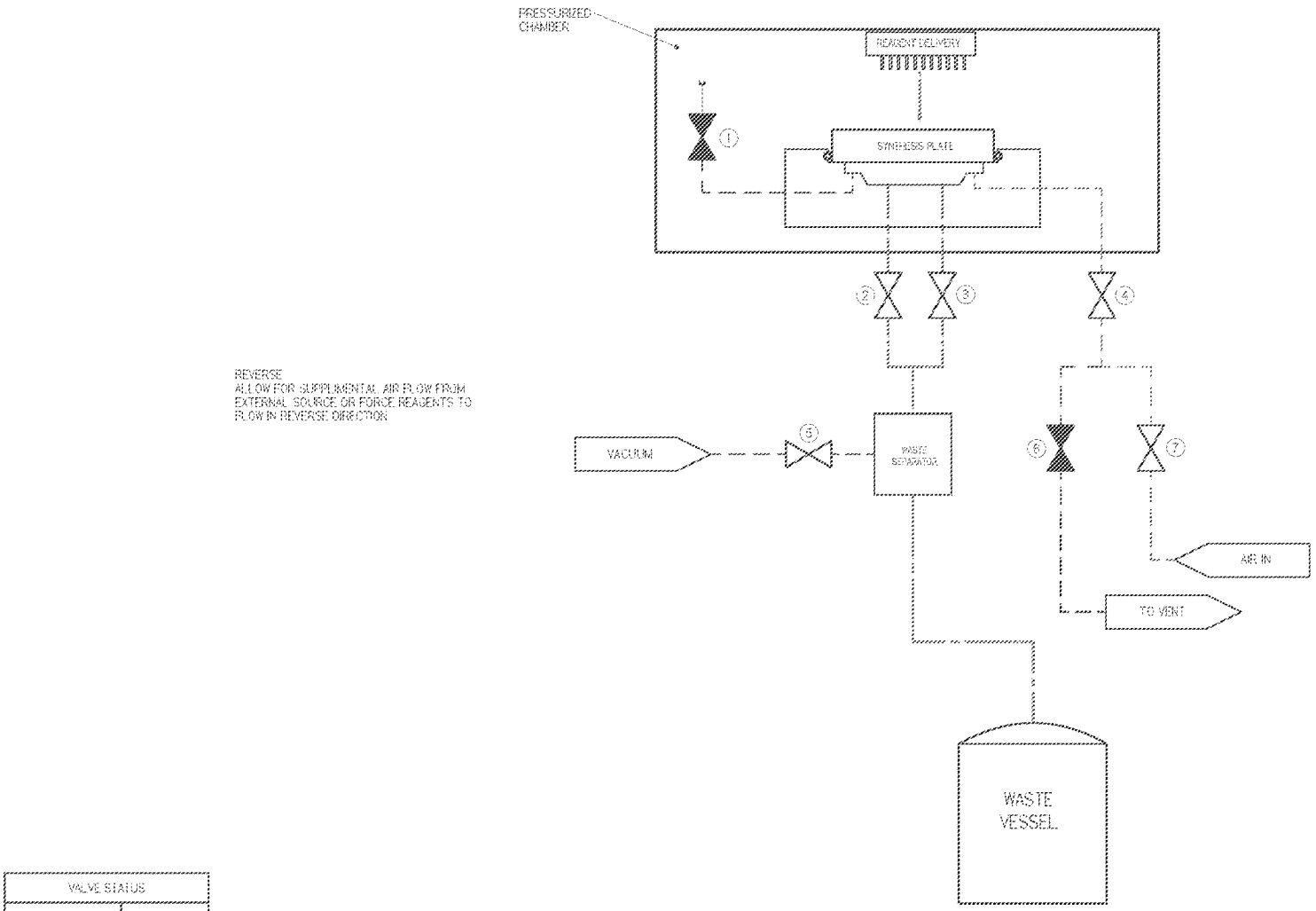

With reference to FIGS. 6 and 15, in some embodiments a "reverse flow" condition is used, where valves 1 and 6 are closed, and valves 2-5 and 7 are open. In this condition, the source of compressed air 190 is activated, creating a higher pressure in the vacuum chamber 98 than in the surrounding environment 178. In this condition, the lower pressure in the surrounding environment 178 draws reagent material up into the synthesis plate 30 and/or retains the reagent in the synthesis plate (e.g., with the pressure of the surrounding environment 178 being lower than that of the pressure in the vacuum chamber 98, and the pressure in the vacuum chamber 98 being lower than that in the waste separator 194 and waste vessel 198).

Although various embodiments have been described in detail with reference to certain examples illustrated in the drawings, variations and modifications exist within the scope and spirit of one or more independent aspects described and illustrated.

What is claimed is:

1. A synthesizer system comprising:

a vacuum block;

a sealing plate coupled to the vacuum block and positioned above the vacuum block along a vertical direction, the sealing plate having a sealing plate central opening;

a synthesis plate having a plurality of wells, the synthesis plate located at least partially within the sealing plate central opening; and an inflatable seal positioned laterally between the sealing plate and the synthesis plate, wherein the inflatable seal is in direct physical contact with both the sealing plate and with a sidewall of the synthesis plate along a lateral direction that is perpendicular to the vertical direction, thereby forming a lateral seal between the sealing plate and the synthesis plate and thereby also centering the sealing plate within the sealing plate central opening.

2. The synthesizer system of claim 1, wherein the inflatable seal includes a tubular, compliant structure.

3. The synthesizer system of claim 1, wherein the inflatable seal includes a main body forming a loop, and a stem extending from the main body.

4. The synthesizer system of claim 3, wherein the main body extends at least substantially entirely around the synthesis plate.

5. The synthesizer system of claim 3, wherein the stem includes an open end, wherein the synthesizer system further includes a removable valve having a projecting region configured to extend into the open end of the stem.

6. The synthesizer system of claim 1, further comprising a seal retainer releasably coupled to the sealing plate, wherein the seal retainer fits over the stem.

7. The synthesizer system of claim 6, wherein the seal retainer includes a lip that extends over a top of the inflatable seal.

8. The synthesizer system of claim 1, wherein the synthesis plate includes an outer surface and a rib extending from the outer surface, wherein the rib is configured to contact and retain the inflatable seal.

9. The synthesizer system of claim 1, wherein the sealing plate is a first sealing plate, wherein the synthesizer system includes a second sealing plate disposed between the first sealing plate and the vacuum block.

10. The synthesizer system of claim 1, wherein a vacuum chamber is disposed between a top of the vacuum block and a bottom of the synthesis plate.

11. The synthesizer system of claim 10, further comprising a pressure transducer in communication with the vacuum chamber.

12. The synthesizer system of claim 10, further comprising apertures disposed along an upper surface of the vacuum block.

13. The synthesizer system of claim 10, further comprising a plurality of valves in communication with the vacuum chamber.

14. The synthesizer system of claim 13, further comprising a waste separator coupled to at least one of the valves, a waste vessel coupled to the waste separator, and a vacuum source coupled to the waste separator.

15. The synthesizer system of claim 13, wherein one of the valves is configured to control a flow of air between the vacuum chamber and a pressurized chamber external to the synthesis plate and vacuum block.

16. The synthesizer system of claim 13, further comprising an air vent coupled to at least one of the valves, and an air compressor coupled to at least one of the valves.

17. The synthesizer system of claim 13, wherein the plurality of valves includes a first valve, a second valve, a third valve, a fourth valve, a fifth valve, a sixth valve, and a seventh valve, wherein the first valve is an air valve coupled to both the vacuum chamber and an environment external to the synthesis plate and the vacuum block, wherein the second and third valves are fluid valves coupled to both the vacuum chamber and to a waste separator, wherein the fourth valve is an air valve coupled to the vacuum chamber, wherein the fifth valve is an air valve coupled to both the waste separator and to a vacuum source, wherein the sixth valve is an air valve coupled to both the fourth valve and to an air vent, and wherein the seventh valve is an air valve coupled to both the fourth valve and to a source of compressed air.

18. A synthesizer system comprising:

a vacuum block;

a sealing plate coupled to the vacuum block;

a synthesis plate having a plurality of wells;

a vacuum chamber defined between a bottom of the synthesis plate and the vacuum block; and a plurality of valves coupled to the vacuum chamber, wherein the plurality of valves includes a first valve, a second valve, a third valve, a fourth valve, a fifth valve, a sixth valve, and a seventh valve, wherein the first valve is an air valve coupled to and located between the vacuum chamber and an environment external to the synthesis plate and the vacuum block, wherein the second and third valves are each fluid valves coupled to and located between the vacuum chamber and a waste separator, wherein the fourth valve is an air valve coupled to the vacuum chamber, wherein the fifth valve is an air valve coupled to and located between the waste separator and a vacuum source, wherein the sixth valve is an air valve coupled to and located between the fourth valve and an air vent, and wherein the seventh valve is an air valve coupled to and located between the fourth valve and an air compressor.

19. The synthesizer system of claim 18, further comprising a pressure transducer in communication with the vacuum chamber.

20. The synthesizer system of claim 18, wherein the valves are configured to be opened or closed to generate a no flow condition, a pressure push condition, a wet condition, a dry condition, and a reverse flow condition.

21. The synthesizer system of claim 1, wherein the sealing plate includes a lip that extends over a top of the inflatable seal.

22. The synthesizer system of claim 1, further comprising an under plate positioned between the vacuum block and the sealing plate.

* * * * *